United States Patent [19]

Oberly

[11] Patent Number: 4,733,595

[45] Date of Patent: Mar. 29, 1988

[54] MUZZLE ARC SUPPRESSOR FOR ELECTROMAGNETIC RAILGUN

[75] Inventor: Charles E. Oberly, Urbana, Ohio

[73] Assignee: The United States of America as represented by the Secretary of the Air Force, Washington, D.C.

[21] Appl. No.: 3,169

[22] Filed: Jan. 14, 1987

[51] Int. Cl.[4] ..... F41F 1/02

[52] U.S. Cl. ..... 89/8; 124/3; 310/12; 338/21; 338/55

[58] Field of Search ..... 89/8; 124/3; 310/10–14; 307/566, 318; 338/13, 21, 55

[56] References Cited

U.S. PATENT DOCUMENTS

| | | | |
|---|---|---|---|
| 2,274,537 | 2/1942 | Ehlert | 338/55 |
| 4,285,839 | 8/1981 | Wong | 338/21 X |
| 4,347,463 | 8/1982 | Kemeny et al. | 89/8 X |
| 4,423,662 | 1/1984 | McAllister | 89/8 |
| 4,437,383 | 3/1984 | Deis et al. | 89/8 |
| 4,480,523 | 11/1984 | Young et al. | 89/8 |
| 4,572,964 | 2/1986 | Honig | 307/106 |
| 4,641,567 | 2/1987 | Creedon | 89/8 |

*Primary Examiner*—Stephen C. Bentley

*Attorney, Agent, or Firm*—Fredric L. Sinder; Donald J. Singer

[57] ABSTRACT

A muzzle arc suppressor allowing rapid repetitive refiring of railguns. A varistor or varistors electrically connect the muzzle ends of a railgun. Resistive inserts are placed inside the rails near the muzzle end. When the railgun projectile reaches the resistive inserts, the voltage across the varistor increases to above the varistor breakdown voltage, thereby commutating the railgun current from the projectile to the varistor, and dissipating excess magnetic energy through resistance heating of the varistor. The varistor is preferably made of zinc oxide, which is temperature invariant over a wide temperature range. The varistor may be pre-cooled to increase its energy absorbtion ability. A specific embodiment of the arc suppressor has the zinc oxide varistor conformably shaped to surround the rails. The conformably shaped varistor includes coolant passages.

7 Claims, 4 Drawing Figures

MUZZLE ARC SUPPRESSOR FOR ELECTROMAGNETIC RAILGUN

RIGHTS OF THE GOVERNMENT

The invention described herein may be manufactured and used by or for the Government of the United States for all governmental purposes without the payment of any royalty.

BACKGROUND OF THE INVENTION

The present invention relates generally to electromagnetic railguns, and more specifically to a novel railgun muzzle arc suppressor.

Railguns are being considered as a primary component of a space based ballistic missile defense system. Additionally, smaller railguns have been considered for use in ground support. One of the primary requirements for a successful railgun is that it be able to fire repeatedly at a very rapid rate.

Railguns operate by using a very large electric current to create a very strong magnetic field. The interaction of the electric current and the magnetic field creates a force called a Lorentz force. The Lorentz force can propel an electrically conductive projectile between a pair of electrically conductive rails. The projectile can be accelerated at several 100,000's of g's and can reach muzzle velocities of several kilometers per second. As the projectile leaves the muzzle end of the railgun, thus opening the rail-projectile-rail circuit, the energy built-up in the magnetic field surrounding the rails is sufficient to cause arcing from the rail ends to the projectile. This arcing causes erosion and thermal damage to both the projectile and to the muzzle ends of the rails. The desired rapid and repetitive operation is prevented by the cummulative muzzle damage and wear.

Three general solutions have been proposed to reduce or eliminate the muzzle arcing. The first solution ceases adding energy to the railgun system well before the projectile leaves the rails, so that the built-up system energy is used to further accelerate the projectile along the rails until the energy falls below the point at which arcing will occur. The second solution provides additional railgun circuitry to electrically recover the excess energy to be reused in firing successive projectiles. The third solution to the muzzle arcing problem dissipates the excess magnetic energy by converting it to heat energy through a resistance. The first solution suffers primarily from requiring railgun lengths that are too long. The second solution is conceptially appealing, but a completely successful design using this approach has not appeared. U.S. Pat. No. 4,572,964 to Honig provides a brief discussion of the problems of the first solution and an example of a proposed apparatus using the second solution.

The third solution may present the simplest path to a successful rapid fire railgun. However, presently proposed apparatus implementing the third solution will only suppress, but not eliminate, arcing. Examples of those apparatus may be found in U.S. Pat. Nos. 4,423,662 to McAllister, and 4,437,383 to Deis et al. Deis et al also shows cooling of the resistive elements. Because energy dissipation by resistance converts the energy into heat, it is important that adequate cooling be provided to remove the heat at a fast enough rate to allow rapid refiring. Deis et al fails to disclose any teaching of how sufficient and rapid cooling may be accomplished.

It is, therefore, a principal object of the present invention to eliminate destructive muzzle arcing in railguns by dissipating excess railgun energy through a resistance.

It is another object of the present invention to provide a cooling system for the resistance that removes the converted heat energy from the resistive fast enough to permit rapid repetitive firing.

It is a further object of the present invention to provide a resistance that is conformable to the shape of the railgun rails to increase energy dissipation efficiency.

It is yet another object of the present invention to integrate the cooling system with the resistance to increase cooling efficiency.

A feature of the present invention is that it eliminates muzzle flash and reduces the signature of the railgun system.

Another feature of the present invention is that it eliminates the adding of excessive charged particles to the environment.

An advantage of the present invention is that nearly no railgun system energy leaks through the resistance during active acceleration of the projectile.

Another advantage of the present invention is that it provides an adaptable structure for both energy dissipation and reclamation of excess railgun magnetic energy.

Yet another advantage of the present invention is that its very large energy absorption ability permits a reasonably sized dissipating and cooling structure.

SUMMARY OF THE INVENTION

The present invention provides a structure for preventing railgun muzzle arcing by dissipating excess magnetic energy as heat through a resistance. The unique discovery of the present invention is that the breakdown voltage property of a varistor permits a simple apparatus which, combined with the nearly temperature invariant material properties of zinc oxide over a wide range of temperatures, may be pre-cooled to a very low temperature, followed by a very large temperature rise during operation of the railgun, thereby dissipating a very large amount of excess system energy with a minimum of material, at a rapid rate, and repeatedly.

Accordingly, the present invention is directed to an apparatus comprising a pair of generally parallel electrical conducting rails defining therebetween a path for projecting an electrically conductive projectile. One or more varistors electrically connect the rails. Means for triggering a sudden decrease in resistance across the varistor, thereby permitting substantial current to flow between the rails across the varistor, is provided. The triggering means may comprise resistive inserts positioned along the inside of the rails to commutate the current from the rail-projectile-rail path to the rail-varistor-rail path. The varistor is preferably made of zinc oxide and the resistive inserts made of ceramic.

The invention additionally includes the varistor being conformably shaped to substantially surround the rails and the addition of cooling passages through the varistor.

DESCRIPTION OF THE DRAWINGS

The present invention will be more clearly understood from a reading of the following detailed description in conjunction with the accompanying drawings wherein.

DETAILED DESCRIPTION

Figure 1:
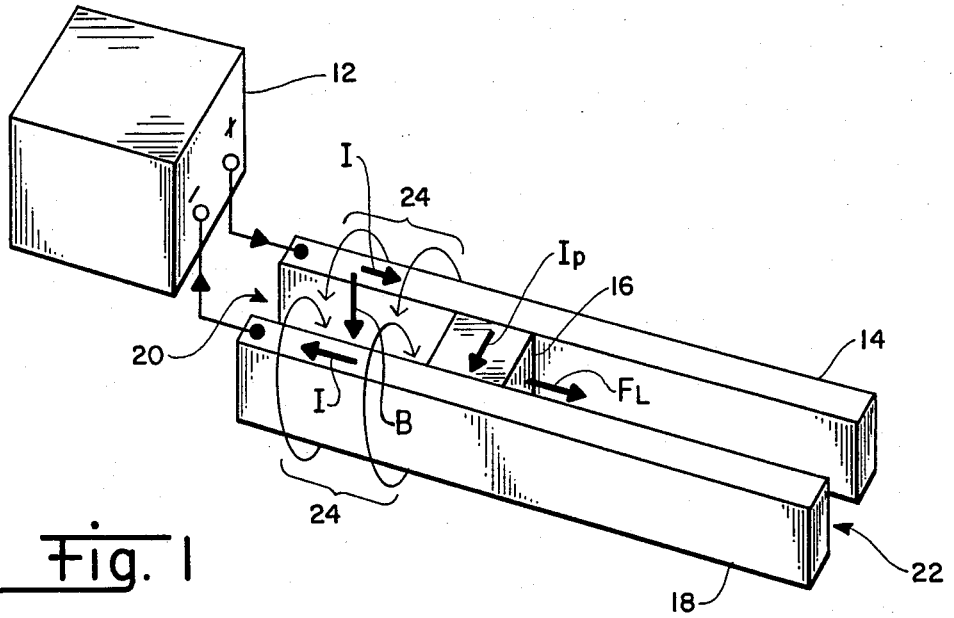
Fig. 1 PRIOR ART
FIG. 1 is a perspective diagrammatic view of a typical railgun.

Referring now to FIG. 1 of the drawings, there is shown a perspective diagrammatic view of a typical railgun. The railgun includes a megampere current source 12 that supplies current 1 which conducts along a first electrically conductive rail 14, through a conductive projectile 16, and returns along a second conductive rail 18 back to current source 12. Rails 14 and 18 have a breech end 20 and a muzzle end 22. Current 1 creates around rails 14 and 16 a very large magnetic field 24 in the directions shown. The vector cross product of the current $I_P$ flowing through projectile 16 with the downwardly directed magnetic field vector B between rails 14 and 18 creates a Lorentz force $F_L$ that accelerates projectile 16 between rails 14 and 18. A housing or barrel (not shown) restrains rails 14 and 18 from separating due to other Lorentz forces. A dielectric material (also not shown) separates the rails and helps prevent arcing between them.

Figure 2:
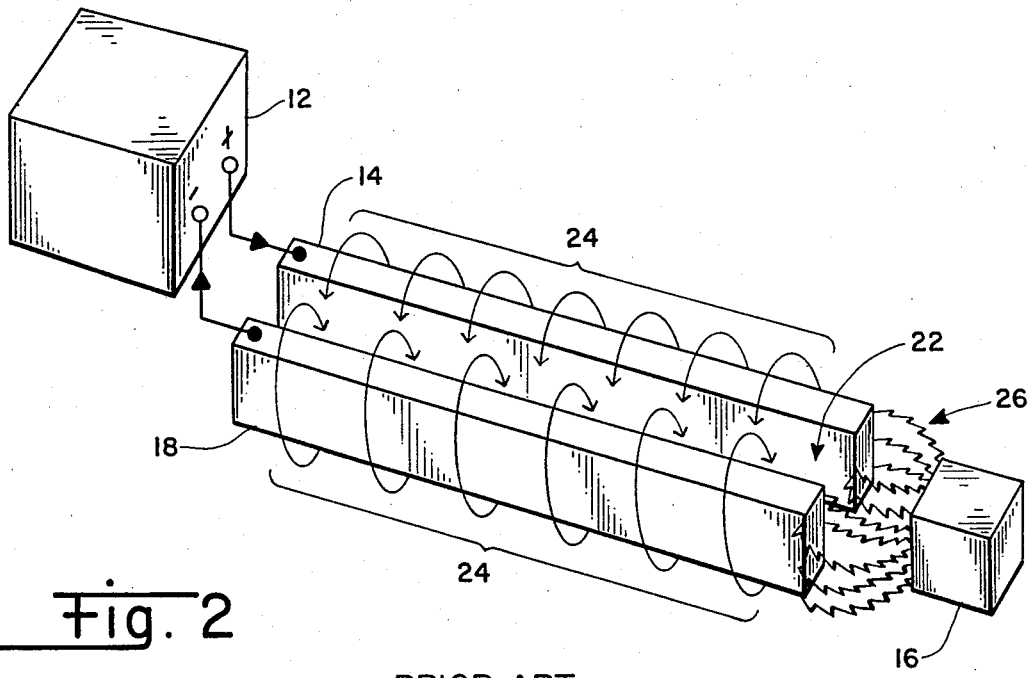
Fig. 2 PRIOR ART
FIG. 2 is a perspective diagrammatic view of the railgun of FIG. 1 showing the arcing that occurs when the projectile leaves the muzzle.

FIG. 2 shows the muzzle arcing 26 that occurs when projectile 16 leaves muzzle end 22. Current source 12 will typically cease delivery of current to rails 14 and 18 prior to projectile 16 leaving muzzle end 22. Even with current source 12 shut-off, the large magnetic field 24 created by the megampere current levels is typically of the order of 20–30 Teslas. As projectile 16 leaves muzzle end 22, suddenly opening the circuit along the rails and projectile, the large amount of energy stored in the magnetic field, which can generate a voltage of 10's of kilovolts across the rail ends, will seek the least resistive path in which to dissipate. Without modification, it will dissipate by arcing from rail 14 to projectile 16 to rail 18.

Figure 3:
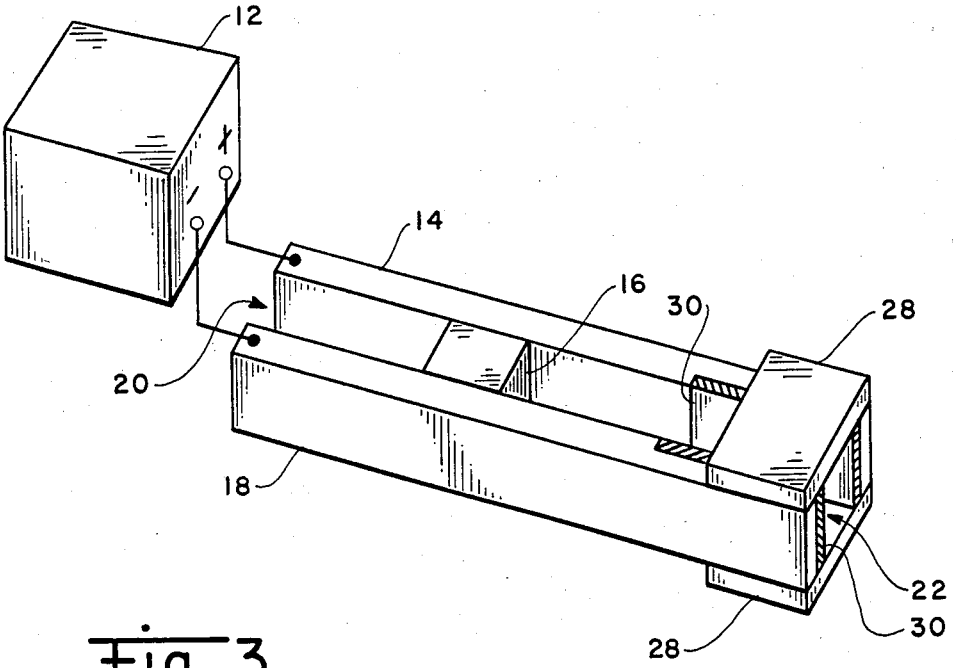
FIG. 3 is a perspective view of the railgun of FIG. 1 showing the addition of a ZnO varistor at the railgun muzzle to provide dissipation of the railgun system energy by resistance heating; and, FIG. 4 is a perspective view of a railgun showing a conformably shaped ZnO varistor at the railgun muzzle with integral cooling passages.

FIG. 3 is a perspective diagrammatic view of the railgun of FIG. 1 showing the addition of a pair of zinc oxide (ZnO) varistors 28 replacing the dilectric across the muzzle end 22 of the railgun to provide an alternative path to arcing for the current due to the "breakdown" of magnetic field 24. Varistors typically have a highly nonlinear relationship between voltage across and resistance through them. The resistance is typically very high until a particular voltage is reached, at which time the resistance drops rapidly. The difference between the high and low resistances is of sufficient orders of magnitude that, in a railgun, the voltage at which the resistance begins to rapidly drop may be viewed as a breakdown voltage. Ceramic resistive inserts 30 are attached to the inside of muzzle end 22 of rails 14 and 18. While projectile 16 remains between rails 14 and 18, the current supplied by current source 12, or alternatively, the current supplied by the breakdown of field 24, has two possible parallel paths to complete its circuit. The first path is through projectile 16, the second path is through varistors 28. As long as the resistance along the path through projectile 16 is low, the current will preferentially flow through it. While normally in parallel circuits some current will flow through the path of higher resistance, causing current leakage and energy losses in systems such as are shown by Deis et al and by MacAllister, the low resistance path through projectile 16 is sufficiently low so that the voltage across varistors 28 will not rise above their breakdown voltage, and nearly no current will flow across them. When projectile 16 reaches the less conductive ceramic resistive inserts 30, the sudden increase in resistance along the current path through projectile 16 increases the voltage drop across varistors 28 to above their breakdown voltage and the resistance through the varistors will drop suddenly to a low value. Most of the energy in the system will then begin to dissipate through the alternate current path through varistors 28. As projectile 16 begins to leave the muzzle end 22, the energy that would have gone into destructive arcing will now continue to dissipate as resistive heat energy through varistors 28.

Ceramic resistive inserts 30, which are needed to provide the voltage kick to trigger varistors 28, may be made of other materials providing a resistance, or insulation, higher than the rail materials. The resistive inserts may, for example, be made of tungsten. If made of tungsten, they must be relatively thick to provide a greater resistance than the inside walls of the rails, which will typically already have a tungsten coating to protect the softer typically copper rails from wear. Those with skill in the art will readily see that many other combinations of material may be used to good effect. Those with skill in the art will also readily see that the relative positioning and sizing of the resistive inserts and the varistors along the length of the rails, as well as their number, are a matter of routine calculation and experimentation according to the purposes and effects desired. The required size, and length, of the resistive insert will be affected by the plasma arc which will follow the projectile into the area between the resistive inserts, thereby continuing the flow of current through the rail-projectile-rail path for a time.

The varistors 28 are shown preferably made of ZnO. Recent studies have shown that the varistor performance characteristics of large scale ZnO are nearly invariant from liquid helium temperatures (4° K.) to high temperatures (500° K.). This material quality permits a ZnO muzzle suppressor to be pre-cooled to increase the amount of energy that can be absorbed by resistance heating. Otherwise, the amount of varistor material required to prevent arcing would be greater than could be used in a practical railgun. Calculations show that approximately 70 cc of ZnO pre-cooled to liquid helium temperatures can absorb a megajoule of energy.

Figure 4:
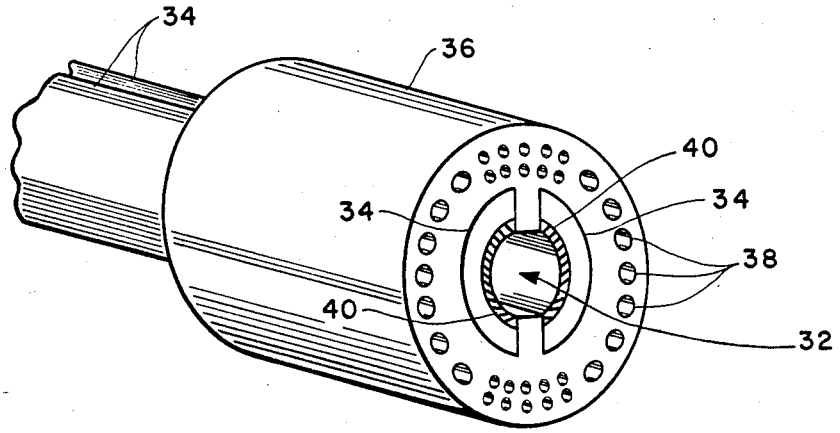

FIG. 4 shows a muzzle end 32 of a pair of rails 34 surrounded by a comformably shaped ZnO varistor barrel 36 having cooling passages 38 for passage of cryogenic fluids such as liquid hydrogen. Ceramic resistive inserts 40 are attached to the inside of muzzle end 32 of rails 34. As the projectile leaves muzzle end 32, the ZnO varistor 36, having been previously cooled to cryogenic temperatures, is heated to its maximum temperature in a few microseconds to a millisecond. During the period between firings, the ZnO varistor 36 can be actively recooled to a low temperature so that it is available to absorb the next burst of waste magnetic energy.

Calculations show that 10's of megajoules in large railguns, delivered by several magampere currents with voltage drops of 10's of kilovolts and projectile velocities approaching 10 km/sec., can be absorbed by ZnO barrel lengths of 1–10 meters.

Those with skill in the art will recognize that the described muzzle arc suppressor is readily amenable to other improvements. For example, the number of cooling passages may be further increased in the area of greater field density near the rail separations and decreased around the outside of the rails. The ZnO barrel may be reinforced to act as part of the housing. Also, the waste magnetic energy need not all be dissipated as heat. The ability of the varistor to act as a rapidly acting very high current, or crowbar, switch can be incorporated into an energy recovery system to reclaim some of the railgun system energy, reducing the thermal stresses on the varistor and increasing system efficiency.

The disclosed apparatus successfully demonstrates the use of a ZnO varistor to suppress railgun muzzle arcing. Though the disclosed use is specialized, it will find application in other areas where large amounts of current or energy needs to be rapidly switched and/or dissipated.

As described above, it is understood that certain modifications to the invention as described may be made, as might occur to one with skill in the field of the invention, within the intended scope of the claims. Therefore, all embodiments contemplated have not been shown in complete detail. Other embodiments may be developed without departing from the spirit of the invention or from the scope of the claims.

I claim:

1. A railgun, comprising:

(a) a pair of generally parallel electrically conductive rails having a breech end and a muzzle end;

(b) an electrically conductive projectile for being propelled along a path defined by the rails;

(c) a varistor electrically connecting the rails; and, (d) means for triggering the varistor to substantially reduce its resistance, thereby permitting conduction of substantial current between the rails through the varistor.

2. The railgun according to claim 1, wherein the triggering means comprise resistive inserts positioned along the inside of the rails.

3. The railgun according to claim 1, wherein the varistor comprises zinc oxide.

4. The railgun according to claim 2, wherein the resistive inserts comprise a ceramic.

5. The railgun according to claim 1, further comprising cooling passages through the varistor.

6. A railgun, comprising:

(a) a pair of generally parallel electrically conductive rails having a breech end and a muzzle end;

(b) an electrically conductive projectile for being propelled along a path defined by the rails;

(c) a varistor electrically connecting the rails;

(d) means for triggering the varistor to substantially reduce its resistance, thereby permitting conduction of substantial current between the rails through the varistor; and, (e) wherein the varistor is conformably shaped to substantially surround the rails.

7. The railgun according to claim 6, further comprising cooling passages through the varistor.

* * * * *